United States Patent [19]

Munroe

[11] Patent Number: 4,612,423

[45] Date of Patent: Sep. 16, 1986

[54] LINE SWITCH

[75] Inventor: Ronald G. Munroe, Staten Island, N.Y.

[73] Assignee: Eagle Electric Mfg. Co. Inc., Long Island City, N.Y.

[21] Appl. No.: 694,029

[22] Filed: Jan. 23, 1985

[51] Int. Cl.[4] ..... H01H 15/10

[52] U.S. Cl. ..... 200/16 R; 200/72 A; 200/298; 339/97 R

[58] Field of Search ..... 200/51.16, 72 A, 284, 200/16 R, 16 A, 16 B, 16 C, 16 D, 16 E, 16 F, 298; 174/84 C; 339/97 R

[56] References Cited

U.S. PATENT DOCUMENTS 1,783,635 12/1930 Tregoning ..... 200/72 A 3,689,723 9/1972 Ludwig ..... 200/284 X

*Primary Examiner*—A. D. Pellinen

*Assistant Examiner*—Morris Ginsburg

*Attorney, Agent, or Firm*—Kirschstein, Kirschstein, Ottinger & Israel

[57] ABSTRACT

A line switch for twin-wire cable comprises a switch housing of one-piece clamshell-type construction, a pair of terminals mounted within the housing, a leaf spring having a pair of movable contact portions within the housing, and an armature for moving the movable contact portions between a closed and an open position. A cover portion and a body portion of the switch housing are hinged together along a common longitudinal edge which serves as a living hinge. The housing has a channel in which an open elongated electrical wire is laid, and a piercing projection integral with a stationary contact portion of the terminals is operative to pierce through and electromechanically engage the open wire when the cover portion is pivoted to close the body portion in an assembled position. Snap-action legs maintain the cover and body portions in the assembled position.

20 Claims, 6 Drawing Figures

FIG. 1
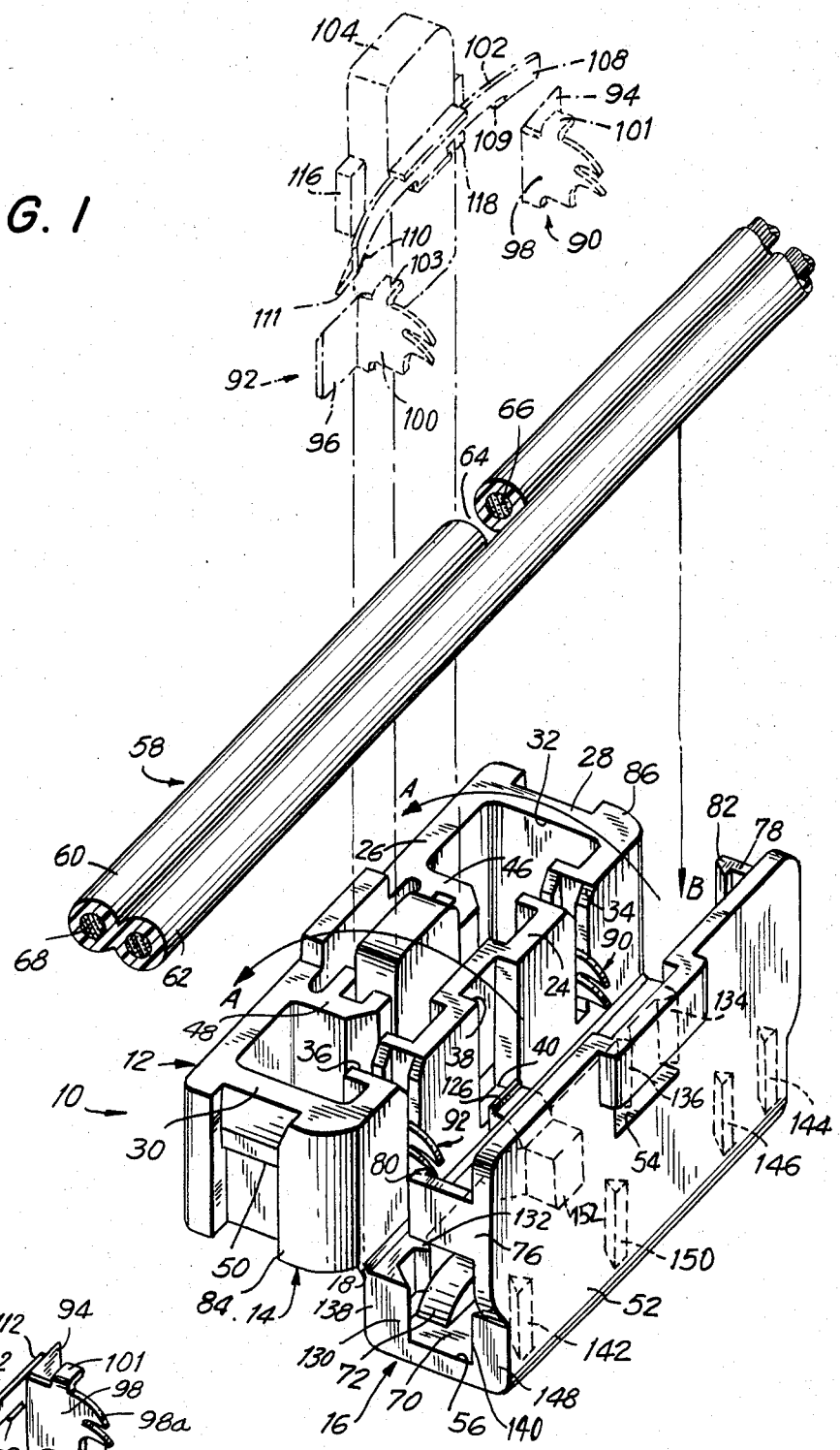
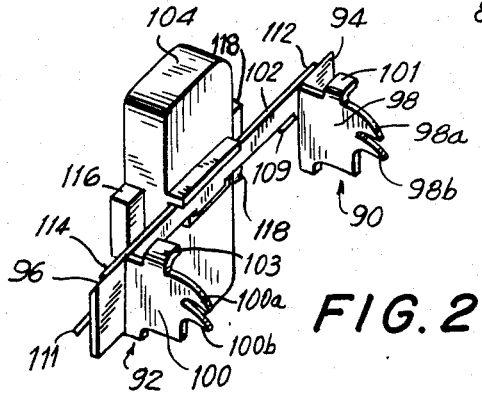
FIG. 2

FIG. 3
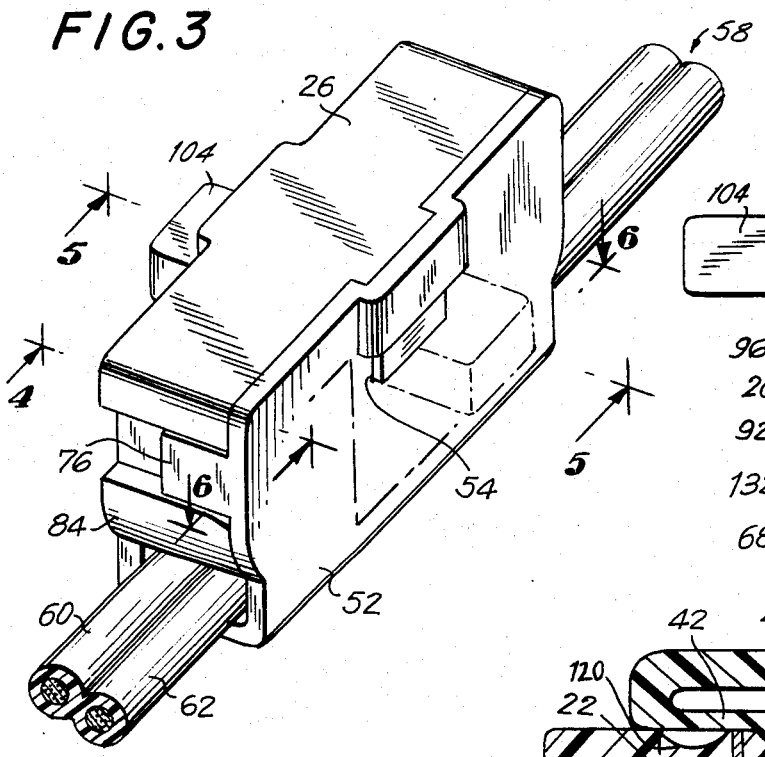
FIG. 4
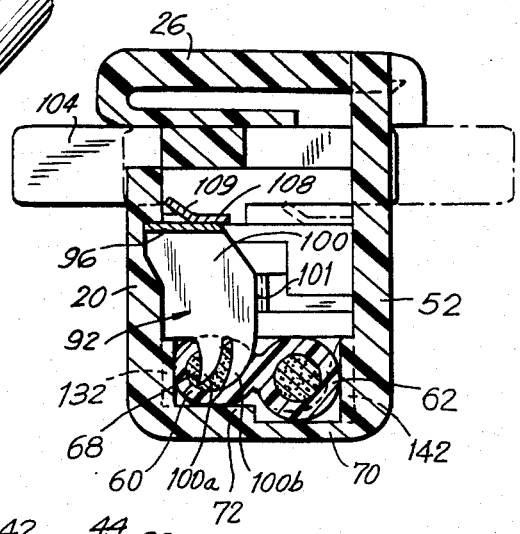
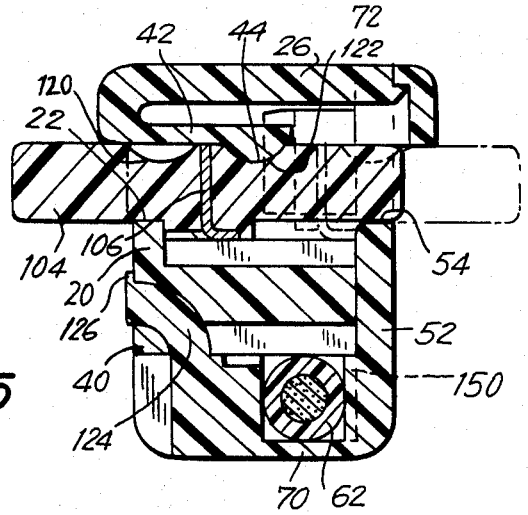
FIG. 5
FIG. 6
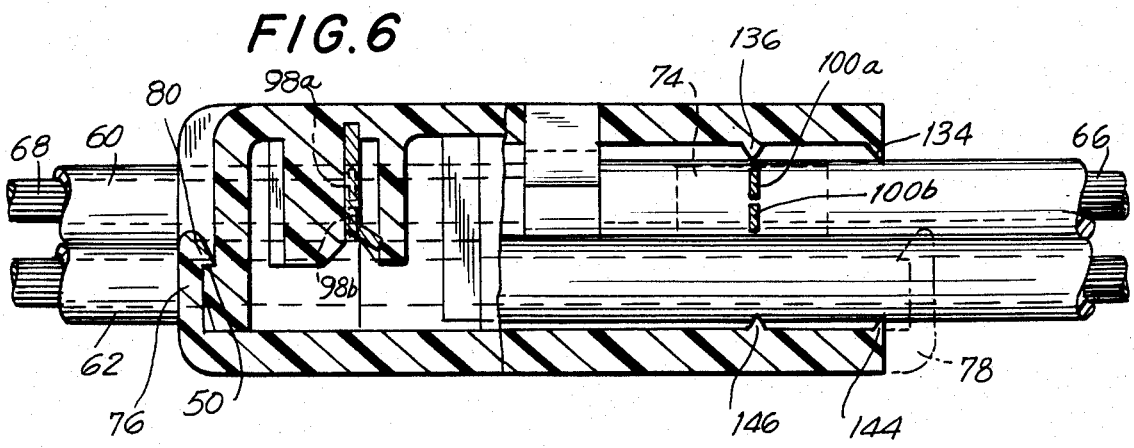

LINE SWITCH

BACKGROUND OF THE INVENTION

1. Field of the Invention

This invention generally relates to a line switch for electrical cable and, more particularly, to a line switch of a novel clamshell-type construction which is particularly suitable for ready installation anywhere along a twin-wire cable.

2. Description of the Prior Art

Line switches for electrically connecting an electrical signal to a load, or for electrically disconnecting the signal from the load, are, of course, well-known devices. An electrical wire typically is routed through a housing of the line switch, and various electrical components within the housing are operative to make electrical contact with the wire therein. Although generally satisfactory for their intended purposes, the known line switches are possessed of certain disadvantages. For example, the known line switches for twin-wire cable are of multi-part construction, and the assembly and inventory of such multi-part switches by original equipment manufacturers (OEMs) are often a problem because of unbalanced stock of the various parts, particularly when line switches are needed in great quantity for a specific application. In addition, the assembly of such a multi-part line switch generally takes a relatively long period of time due, in large part, to the fact that the twin wire must be slit and separated in order to fit into a cover for the housing, and thereupon a screw nut, or a rivet, is needed in order to complete the overall switch assembly. Generally, these multi-part line switches are operated by turning a wheel and, if the wheel is turned in the wrong direction, then the internal switching parts can be damaged. Furthermore, the known line switches cannot accommodate wires of different sizes and, hence, different models of the switch are needed for different wire sizes, e.g. SPT-1 or SPT-2, making it necessary for the OEM to stock more than one switch size.

SUMMARY OF THE INVENTION

1. Objects of the Invention

It is a general object of the present invention to overcome the aforementioned drawbacks of prior art line switches.

It is another object of the present invention to provide a reliable line switch, particularly for twin-wire cables.

It is a further object of the present invention to provide a reliable line switch which has a minimum number of parts and is inexpensive to manufacture, inventory and assemble.

It is still another object of the present invention to provide a reliable line switch which is durable in use and has a long working lifetime.

It is yet another object of the present invention to provide a line switch having a switch housing of a novel one-piece clamshell-type construction.

It is a still further object of the present invention to provide a line switch which can accommodate cables of different sizes.

It is another object of the present invention to provide a line switch having a fast snap-action "make-and-break" electrical characteristic which is particularly suited for cables carrying direct current or alternating current.

2. Features of the Invention

In keeping with these objects, and others which will become apparent hereinafter, one feature of the invention resides, briefly stated, in a line switch which comprises a minimum number of parts, namely, an electrically-insulating switch housing, a pair of electrically-conducting terminals, a pair of electrically-conducting and interconnected movable contact portions of one-piece construction, and an electrically-insulating armature. This five-part construction has the following advantageous features.

The switch housing has a body portion and an integral cover portion hinged to the body portion for pivoting movement about a longitudinal axis. The body portion has a base wall in which a first slot is formed, and side walls extending from the base wall and bounding an interior space within the body portion. One of the side walls extends along a longitudinal direction, and has a pair of recesses formed therein. The recesses are longitudinally spaced apart from each other by a predetermined distance. Another of the side walls extends generally parallel to the aforementioned one side wall, and has a resilient tab integral with the other side wall.

The cover portion has a top wall in which a second slot is formed, and channel walls bounding a longitudinally-extending channel in which an open elongated electrical wire, preferably one of the wires from a twin-wire cable, is inserted. The open wire has longitudinally spaced-apart electrical conductors which are received along the channel. The cover portion is pivotable from an access position in which the open wire is freely laid along the channel, to an assembled position in which the top wall of the cover portion overlies the base wall of the body portion and in which the first and second slots are in mutually juxtaposed alignment along a transverse direction.

In order to maintain the assembled position in a secure manner, the body portion and the cover portion are provided with cooperating locking surfaces for maintaining the assembled position with a snap action. In a preferred embodiment, the cover portion has a pair of resilient locking arms at opposite end regions of the top wall, and the body portion has a pair of undercut locking shoulders which are snappingly engaged by the locking arms in the assembled position.

Each terminal is fixedly mounted in a respective one of the recesses formed in the one side wall. Each terminal has a stationary contact portion mounted within the interior space of the body portion, and a piercing projection extending transversely from the stationary contact portion and outwardly of the body portion. Each piercing projection has a sharp free end operative for piercing through and electromechanically engaging a respective conductor in the assembled position of the cover portion.

The interconnected movable contact portions also are mounted within the interior space of the body portion, and are longitudinally spaced apart from each other by the predetermined distance. In a preferred embodiment, the movable contact portions are integral with and located at opposite end regions of a leaf spring.

The armature carries the movable contact portions and is mounted for joint movement therewith along the transverse direction between a closed and an open position in which the movable contact portions electromechanically engage and are disengaged from, respectively, the stationary contact portions, thereby to electrically connect and disconnect, respectively, the electrical conductors. The armature has a pair of transversely spaced-apart indents, each engageable by the resilient tab to affirmatively maintain the armature in a selected one of the closed and the open positions.

Hence, in accordance with this invention, a reliable line switch is provided with a minimum number of parts, e.g. on the order of five parts, which is inexpensive to manufacture, inventory and assemble. The switch is durable in use and has a long working lifetime.

In accordance with another feature of this invention, the body portion and the cover portion are hinged along a common longitudinally-extending edge region having a reduced thickness and constituting a living hinge. This novel clamshell-type construction for the housing provides for a rapid assembly of the line switch on the open wire. No longer is it necessary, as in the prior art, to threadedly connect a cover portion onto a body portion of the switch housing.

Still another feature of this invention resides in providing a pair of raised supports on a support wall which bounds the aforementioned channel. The height of each raised support on which a respective conductor is laid is sufficient to accommodate conductors of different sizes.

In accordance with another feature of the invention, the switch makes and breaks electrical contact at both movable contact portions. This two-point contact divides the voltage and current signals conducted along the open wire and minimizes the arcing. Furthermore, it is desirable if each stationary contact portion has a knife edge which faces an inclined leading region of each movable contact portion in order to prevent blocking or other mechanical interference between the movable and stationary contact portions during the movement of the armature.

Still another feature is embodied in providing the body portion with a guide hole and a support post therein, and providing the cover portion with a guide pin. During the pivoting movement of the cover portion relative to the body portion, the guide pin is insertable with slight clearance through the guide hole. The guide pin also is provided with a leading lip as considered in the direction of insertion. This lip engages, preferably with snap action, the support post in the assembled position and provides for a tightly locked housing.

Yet another advantageous feature of this invention is to engage the armature at its side opposite the side on which the movable contact portions are carried. Thus, the resilient tab not only serves to affirmatively maintain the armature in the selected open or closed position, but also assists in resiliently pressing the movable contact portions against their associated stationary contact portions in the closed position.

The novel features which are considered as characteristic of the invention are set forth in particular in the appended claims. The invention itself, however, both as to its construction and its method of operation, together with additional objects and advantages thereof, will best be understood from the following description of specific embodiments when read in connection with the accompanying drawings.

BRIEF DESCRIPTION OF THE DRAWINGS

FIG. 1 is an exploded perspective view of a line switch in an access position in accordance with this invention, showing a twin-wire cable in broken-away view prior to placement within the switch;

FIG. 2 is a perspective view of several of the components mounted within the switch of FIG. 1;

FIG. 3 is a perspective view of the line switch of FIG. 1 in an assembled position;

FIG. 4 is a sectional view taken along line 4—4 of FIG. 3;

FIG. 5 is a sectional view taken along line 5—5 of FIG. 3; and

FIG. 6 is a sectional view taken along line 6—6 of FIG. 3.

DETAILED DESCRIPTION OF THE PREFERRED EMBODIMENTS

Referring now to the drawings and, more particularly, to FIG. 1, reference numeral 10 generally identifies a line switch having an electrically-insulating switch housing 12 of one-piece clamshell-type construction. The housing 12 has a body portion 14, and an integral cover portion 16 hinged to the body portion for pivoting movement about a longitudinal axis along the circumferential direction indicated by the arrows A. The body and cover portions share, and are hinged along, a common longitudinally-extending edge region 18 having a reduced wall thickness and constituting a living hinge.

The body portion 14 has a planar base wall 20 in which a first generally rectangular slot 22 is formed, and a plurality of side walls 24, 26, 28, 30 extend from the base wall 20 and bound an interior space 32 within the body portion. The side walls 24, 26 extend along the longitudinal direction, i.e. lengthwise along hinged edge region 18, and the side walls 28, 30 extend along the transverse direction at opposite end regions of the body portion. The side walls 24, 26, 28, 30 form a box-like enclosure having an open top which, as explained below, is covered by the cover portion 16 when the latter is pivoted from an access position, shown in FIG. 1, along the direction of arrows A, to an assembled position, shown in FIG. 3. Side wall 24 is interrupted along its length, and has a pair of recesses 34, 36 formed therein and longitudinally spaced apart from each other by a predetermined distance on the order of 11/16" in a preferred embodiment.

Intermediate the recesses is a guide hole 38 having a support post 40 therein. Side wall 26 lies in a plane generally parallel to that of side wall 24, and has a resilient tab 42 (see FIG. 5) integral with the side wall 26. The tab 42, as described below, is provided at its free end with a bulge 44.

At the central region of the side wall 26, a pair of track walls 46, 48 of F-shaped cross-section extend from the side wall 26 into the interior space 32 and face each other to bound a slide track extending along a transverse direction. The resilient tab 42 and the bulge 44 are located at least in part and extend slightly into the slide track.

Each side wall 28, 30 is provided at its exterior surface with an undercut shoulder 50 which, as explained below, is snappingly engaged by cooperating locking surfaces on the cover portion 16.

The cover portion 16 has a generally planar top wall 52 in which a second rectangular slot 54 is formed, and channel walls bounding a longitudinally-extending channel 56 in which a cable 58 is received. As shown in FIG. 1, the cable 58 is a twin-wire cable having an open wire 60 alongside a continuous wire 62. Each wire is jacketed with electrical insulation and has an inner electrically-conductive metallic core consisting of either stranded conductors or a solid conductor surrounded by an outer sheath of insulation. The wire jackets are joined together lengthwise. The open wire 60 is interrupted, as at zone 64, typically by cutting away a short segment of the wire 60 and leaving behind two conductors 66, 68 which are not in electrical communication and which are longitudinally spaced apart from each other. In accordance with this invention, the line switch 10 will electrically connect and bridge the two conductors 66, 68, or will electrically disconnect and unbridge these two conductors. The channel 56 is wide enough to accommodate both the open wire 60 and the continuous wire 62 of the twin-wire cable 58, although it readily will be understood that it is sufficient that only the open wire 60 be laid in the channel 56.

The channel 56 is bounded by support wall 70 on which a pair of raised supports 72, 74 are integral therewith. The raised supports 72, 74 are longitudinally spaced apart from each other by said predetermined distance. Each raised support is curved in longitudinal section. The outer curved surface of each raised support lies underneath and supports the respective conductors 66, 68. The other wire 62 lies adjacent, but preferably not on, the raised supports, since the supports occupy only about one-half of the total width of the total channel 56. The raised supports enable the switch to accommodate wires of different sizes, as described in further detail below.

The cover portion 16 also has a pair of resilient locking arms 76, 78 whose free ends terminate in locking fingers 80, 82, respectively. The locking arms 76, 78 deflect outwardly away from each other during the pivoting of the cover portion onto the body portion until the locking fingers 80, 82 engage the aforementioned undercut shoulders 50 with a snap-type action.

In FIG. 1, the cover portion 16 is shown in its open or cable-admitting position in which the cable 58 is freely laid without mechanical interference into and along the channel 56 by being inserted in the direction of the arrow B. Thereupon, the cover portion 16 is pivoted in the direction of the arrows A to the assembled position, shown in FIGS. 3 and 4, wherein the top wall 52 of the cover portion 16 overlies, and extends generally parallel to, the base wall 20 of the body portion 14, and in which the aforementioned first and second rectangular slots 22 and 54 are positioned in a mutually juxtaposed alignment along the same transverse direction along which the track extends. During this pivoting movement, the arms 76, 78 are deflected outwardly and are urged apart by the curved end shoulders 84, 86 until the arms clear the shoulders and, due to the inherent resilience of the arms, return toward their original undeflected positions and cause the fingers 80, 82 to snappingly engage the undercut shoulders 50. Once the snapping engagement is made, the body and cover portions are affirmatively maintained and locked in the assembled position.

A pair of electrically-conductive terminals 90, 92 each are fixedly mounted in a respective recess 34, 36 formed in the side wall 24. Each terminal has a generally planar, stationary contact portion 94, 96 mounted within the interior space 32 of the body portion 14 and lying against an inner surface of the side wall 24 for support thereagainst. Each terminal also has a double-pronged, generally planar piercing projection 98, 100 extending transversely from its associated stationary contact portion and outwardly of the side wall 24. Each terminal also has a stake or barb 101, 103 bent out of the plane of the projections 98, 100, and is employed, at least partially, to bite into the wall portions bounding the recesses 34, 36 positively to anchor each terminal in place within its associated recess.

The stationary contact portion, the piercing projection and the stake of each terminal are made of a one-piece construction, and preferably are composed of a copper or bronze alloy. Each piercing projection 98, 100 has one, and preferably two, sharp, pronged free ends **98*a*, 98*b* and 100*a*, 100*b* operative for piercing through the jackets of the open wire 60 at opposite ends of the zone 64 and into electromechanical engagement with the conductors 66, 68 in the assembled position. As shown in FIG. 4, the pronged ends 100*a*, 100*b* penetrate through the sides of the open wire and make intimate contact with their conductors at opposite sides of the zone 64** to be bridged.

An electrically-conductive leaf spring 102 is mounted on an armature 104 which together are mounted for joint movement along the track through the rectangular slots 22, 54 along the transverse direction between a closed position, shown in solid lines, and an open position, shown in phantom lines, in FIGS. 3, 4 and 5. The leaf spring 102 has a bent tongue 106 which is wedged into an interior opening in the center of the armature. At the opposite ends of the spring 102 are a pair of electrically-conductive movable contact portions 108, 110 mounted within the interior space 32 of the body portion and spaced apart from each other by said predetermined distance. The movable contact portions 108, 110 are movable toward and away from the stationary contact portions 94, 96 between a closed position and an open position. In the closed position, the movable contact portions electromechanically engage and touch the stationary contact portions, thereby to electromechanically connect and bridge the conductors 66, 68. In the open position, the movable contact portions are disengaged from the stationary contact portions, thereby to electromechanically disconnect and unbridge the electrical conductors.

To prevent any mechanical interference or binding up between the stationary and movable contact portions during their relative movement, each stationary contact portion 94, 96 has a knife edge 112, 114 which makes the initial contact with the respective movable contact portion. In addition, each movable contact portion 108, 110 has a leading region 109, 111 which is inclined so as to flare away from the respective stationary contact portion upon making initial contact therewith.

The armature 104 has a pair of side guides 116, 118 which are fitted with slight clearance for sliding guided movement in the F-shaped track walls 46, 48. The armature 104 has a rectangular cross-section, and passes with slight clearance through the rectangular slots 22, 54. The armature is elongated such that one end of the armature will be situated outwardly of the housing in either the open or the closed position. This exposed end of the armature serves as a convenient handle manually to actuate or push the armature between its closed and open positions.

As shown in its disassembled condition in FIG. 1, the leaf spring 102 has an initial unstressed bowed configuration. When the armature and the spring 102 are assembled within the body portion and moved to the closed position, the movable contact portions 108, 110 are deflected toward the side wall 26 and resiliently press against the stationary contact portions to make a very tight electromechanical contact therewith.

In addition, the resilient tab 42 which is situated behind the armature 104 resiliently presses the armature and the movable contacts thereon toward the stationary contacts. The main purpose, however, of the resilient tab 42 is to cause the bulge 44 to detentively engage either one of two shallow indents 120, 122 formed on the rear of the armature. The resilient tab 42 constantly is pressed against the armature and snaps the bulge 44 into place in either the indent 120 (open position) or the indent 122 (closed position). This detent action serves to maintain the armature in its selected position.

As shown in FIG. 5, a guide pin 124 is inserted with clearance through the guide hole 38 during the pivoting closing movement of the cover portion 16. The guide pin 124 also is provided with a leading lip 126, as considered in the direction of insertion, the lip engaging the support post 40, preferably with a snap-type action, in the assembled position of the cover portion.

The raised supports 72, 74 have a height of about 1/32", and can accommodate wires of at least two different sizes. For example, SPT-1 and SPT-2 wires have insulation thicknesses on the order of 1/32" and 3/64", respectively. Hence, if the smaller diameter wire is inserted on the raised supports 72, 74, then the raised supports elevate the wire to the proper elevation so that the piercing projections 98, 100 effectively can pierce through a predominant portion of the respective conductors 66, 68. If the larger diameter wire is inserted on the raised supports 72, 74, then this larger wire is slightly displaced, but in no event is the electromechanical contact between the conductors and the piercing projections compromised. This feature permits two differently sized wires to be accommodated within the channel 56 without having to use a separate line switch for each wire.

The aforementioned line switch has a fast snap-action "make-and-break" electrical characteristic which is ideal for conductors carrying direct or alternating current. In addition, inasmuch as this line switch makes and breaks electrical contact at two spaced-apart locations, the voltage present at these locations is divided, and any arcing problem is minimized.

The housing preferably is constituted and molded of a synthetic plastic material, as is the armature. The leaf spring and the terminals each are composed of an electrically-conductive material, preferably a copper alloy. The above-described five-part construction of the line switch, namely, the unitary housing, the two terminals, the single leaf spring and the single armature, provides for a minimum number of parts which is inexpensive to manufacture, inventory and assemble.

Still another feature of this invention resides in providing strain relief so that the cable is not easily pulled out of the switch housing. For this purpose, strain relief ribs 130, 132, 134, 136 are integral with wall 138 bounding the channel 56. Rib 130 is located at one end of the wall 138, and rib 132 is spaced longitudinally away from rib 130 and is located at about the midpoint of the raised support 72. Analogously, rib 134 is located at the opposite end region of the wall 138, and rib 136 is similarly located at the midpoint of the raised support 74. At the opposite side of the channel 56 is a wall 148 which lies generally parallel to the wall 138. A corresponding set of strain relief ribs is provided along the elongation of wall 148. Thus, strain relief rib 140 is located at one end region of wall 148 and is located opposite the aforementioned rib 130 on wall 138. Similarly, ribs 142, 144 and 146 are located lengthwise along wall 148 and opposite ribs 132, 134, 136, respectively. Each of the aforementioned ribs extends into the channel 56 and terminates at a pointed free end. Each of the opposing pairs of pointed ribs 130, 140 and 132, 142 and 134, 144 and 136, 146 pinch the cable 58 at four spaced-apart locations lengthwise along the cable and thereby provide a very effective anchoring of the cable so as to resist any forces tending to pull the cable out of the switch housing. Further strain relief can be obtained by the central rib 150 on wall 148 which is located opposite an upright post 152 on wall 138 in the central region of the cover portion. The support post 152 extends into the zone 64.

It will be understood that each of the elements described above, or two or more together, may also find a useful application in other types of constructions differing from the types described above.

While the invention has been illustrated and described as embodied in a line switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A line switch, comprising:

(A) an electrically-insulating switch housing of one-piece construction, said housing having a body portion and an integral cover portion hinged to the body portion for pivoting movement about a longitudinal axis, (i) said body, portion having a base wall in which a first slot is formed, and side walls extending from the base wall and bounding an interior space within the body portion, (ii) one of the side walls extending along a longitudinal direction and having formed therein a pair of recesses longitudinally spaced apart from each other by a predetermined distance, and (iii) another of the side walls extending generally parallel to said one side wall and having a resilient tab integral with the other side wall, (iv) said cover portion having a top wall in which a second slot is formed, and channel walls bounding a longitudinally-extending channel in which an open elongated electrical wire having longitudinally spaced-apart electrical conductors is received;

(v) said cover portion being pivotable from an access position in which the open wire is freely laid along the channel, to an assembled position in which the top wall of the cover portion overlies the base wall of the body portion and in which the first and second slots are in mutually juxtaposed alignment along a transverse direction, (vi) said body portion and said cover portion having cooperating locking surfaces for maintaining the assembled position with a snap action;

(B) a pair of electrically-conducting terminals, each fixedly mounted in a respective one of the recesses, each terminal having a stationary contact portion mounted within the interior space of the body portion, and a piercing projection extending transversely from the stationary contact portion and outwardly of the body portion, each piercing projection having a sharp free end operative for piercing through and electromechanically engaging a respective conductor in said assembled position of the cover portion;

(C) a pair of electrically-conducting and interconnected movable contact portions mounted within the interior space of the body portion and longitudinally spaced apart from each other by said predetermined distance; and (D) an electrically-insulating armature on which the movable contact portions are mounted for joint movement along the transverse direction between a closed and an open position in which the movable contact portions electromechanically engage and are disengaged from, respectively, the stationary contact portions to thereby electrically connect and disconnect, respectively, the electrical conductors, (i) said armature having a pair of transversely spaced-apart indents, each engageable by the resilient tab to affirmatively maintain the armature in a selected one of the closed and the open positions.

2. The line switch as recited in claim 1, wherein said body portion and said cover portion are hinged along a common longitudinally-extending edge region having a reduced thickness and constituting a living hinge.

3. The line switch as recited in claim 1, wherein each of the first and the second slots have a rectangular outline, and wherein the armature has a rectangular cross-section and is mounted with a slight clearance in the aligned slots for sliding movement through the latter.

4. The line switch as recited in claim 1, wherein said channel walls include a support wall, and a pair of raised supports on the support wall and longitudinally spaced apart from each other by said predetermined distance, and wherein each support lies opposite a respective piercing projection in said assembled position of the cover portion to securely support the respective pierced conductor in the channel.

5. The line switch as recited in claim 4, wherein each raised support, has a curved surface facing the respective pierced conductor.

6. The line switch as recited in claim 1, wherein said channel walls bound the channel, with a transverse width sufficient to accommodate a twin-wire cable.

7. The line switch as recited in claim 1, wherein said cover portion has a pair of resilient locking arms at opposite end regions of the top wall, and wherein said body portion has a pair of undercut locking shoulders which are snappingly engaged by the locking arms in the assembled position.

8. The line switch as recited in claim 1, wherein said body portion has track walls extending from the first slot along the transverse direction and bounding a track in which the armature is slidingly mounted.

9. The line switch as recited in claim 1, wherein each terminal has a barb for biting into a wall bounding a respective recess.

10. The line switch as recited in claim 1, wherein said movable contact portions are integral with and located at opposite end regions of a leaf spring.

11. The line switch as recited in claim 1, wherein each stationary contact portion has a knife edge facing the respective movable contact portion.

12. The line switch as recited in claim 11, wherein each movable contact portion has a leading region which is inclined away from the knife edge of the respective stationary contact portion.

13. The line switch as recited in claim 1, wherein each piercing projection has a pair of sharp free ends, each individually piercing through a respective conductor.

14. The line switch as recited in claim 1, wherein said body portion has a guide hole and a support post therein, and wherein said cover portion has a guide pin which is inserted with clearance through the guide hole during the pivoting movement of the cover portion relative to the body portion; and wherein said guide pin has a leading lip, as considered in the direction of insertion, which engages the support post in the assembled position.

15. The line switch as recited in claim 1, wherein said armature has opposite sides, and wherein the movable contact portions are mounted on one of the sides of the armature, and wherein the resilient tab detentively engages the opposite side of the armature and the indents to maintain the armature in the selected position.

16. The line switch as recited in claim 1, and further comprising means for pinching the wire at opposite lateral sides thereof at a plurality of spaced-apart locations lengthwise along the wire to provide strain relief.

17. The line switch as recited in claim 16, wherein said pinching means comprises opposing pairs of pinching ribs integral with the channel walls.

18. A line switch for twin-wire cable, comprising:

(A) an electrically-insulating switch housing of a one-piece clamshell-type construction, said housing having a body portion and an integral cover portion adjacently hinged along a common longitudinal edge to the body portion for pivoting movement about a longitudinal axis, (i) said body portion having a base wall in which a first generally rectangular slot is formed, and side walls extending from the base wall and bounding an interior space within the body portion, (ii) one of the side walls extending along a longitudinal direction and having formed therein a pair of recesses longitudinally spaced apart from each other by a predetermined distance, and (iii) another of the side walls extending generally parallel to said one side wall and having a resilient tab integral with the other side wall, (iv) said cover portion having a top wall in which a second generally rectangular slot is formed, and channel walls bounding a longitudinally-extending channel in which one open elongated electrical wire having longitudinally spaced-apart electrical conductors is received alongside another elongated electrical wire of a twin-wire cable, (v) said cover portion being pivotable from an access position in which the twin-wire cable is freely laid along the channel, to an assembled position in which the top wall of the cover portion overlies the base wall of the body portion and in which the first and second slots are in mutually juxtaposed alignment along a transverse direction, (vi) said cover portion having locking legs for snapping engagement behind a cooperating pair of undercuts on the body portion in the assembled position;

(B) a pair of electrically-conducting terminals, each fixedly staked in a respective one of the recesses, each terminal having a generally planar stationary contact portion mounted within the interior space of the body portion, and a piercing projection extending transversely from the stationary contact portion and outwardly of the body portion, each piercing projection having a pair of sharp free ends operative for piercing through and electromechanically engaging a respective conductor of said open wire in said assembled position of the cover portion;

(C) an elongated leaf spring having a pair of electrically-conducting movable contact portions at opposite end regions of the spring and mounted within the interior space of the body portion and longitudinally spaced apart from each other by said predetermined distance; and (D) an electrically-insulating armature on which the movable contact portions are mounted at one side of the armature for joint sliding movement along the transverse direction between a closed and an open position in which the movable contact portions electromechanically engage and are disengaged from, respectively, the stationary contact portions to thereby electrically connect and disconnect, respectively, the electrical conductors, (i) said armature having at the opposite side thereof a pair of transversely spaced-apart shallow indents, each engageable by the resilient tab to affirmatively detentively maintain the armature in a selected one of the closed and the open positions.

19. The line switch as recited in claim 18, and further comprising means for pinching the twin-wire cable at opposite lateral sides thereof at a plurality of spaced-apart locations lengthwise along the cable to provide strain relief.

20. The line switch as recited in claim 19, wherein said pinching means comprises opposing pairs of pinching ribs integral with the channel walls.

* * * * *